US005964976A

United States Patent [19]

Tanaka et al.

[11] Patent Number: 5,964,976

[45] Date of Patent: Oct. 12, 1999

[54] THERMAL-TRANSFER RECORDING MEDIUM AND THERMAL TRANSFER RECORDING METHOD

[75] Inventors: Noriatsu Tanaka; Yoshiaki Kumazawa, both of Hadano; Hiroyuki Aimoto, Hiratsuka, all of Japan

[73] Assignee: Kabushiki Kaisha Pilot, Tokyo, Japan

[21] Appl. No.: 09/029,714

[22] PCT Filed: Jul. 2, 1997

[86] PCT No.: PCT/JP97/02290

§ 371 Date: Mar. 3, 1998

§ 102(e) Date: Mar. 3, 1998

[87] PCT Pub. No.: WO98/01306

PCT Pub. Date: Jan. 15, 1998

[30] Foreign Application Priority Data

Jul. 5, 1996 [JP] Japan ..... 8-195526
Jul. 5, 1996 [JP] Japan ..... 8-195527

[51] Int. Cl.[6] ..... B41M 5/26

[52] U.S. Cl. ..... 156/235; 428/195; 428/411.1; 428/480; 428/484; 428/913; 428/914

[58] Field of Search ..... 156/235; 428/195, 428/484, 411.1, 480, 913, 914

[56] References Cited

U.S. PATENT DOCUMENTS 5,049,903 9/1991 Suzuki ..... 346/135.1

FOREIGN PATENT DOCUMENTS 0 395 014 10/1990 European Pat. Off. .
1-40378 2/1989 Japan .
4-126290 4/1992 Japan .
5-155139 6/1993 Japan .
07172061 7/1995 Japan .
08052942 2/1996 Japan .

OTHER PUBLICATIONS

Derwent Publications Ltd., London, GB; Class A14, AN 88–164780 XP002087821 & JP 63 102985 A (Toshiba KK), May 7, 1988 (abstract).

*Primary Examiner*—Pamela R. Schwartz
*Attorney, Agent, or Firm*—Finnegan, Henderson, Farabow, Garrett & Dunner, L.L.P.

[57] ABSTRACT

It is an object to provide a thermal-transfer recording medium and its thermal-transfer recording method whereby it is possible to perform good thermal transfer to a durable transfer medium such as plastic film etc., and the transferred image is excellent in resistance to mechanical abrasion, and whereby color reproducibility is excellent when plural colors of thermal transferred inks are printed in layers. A thermal-transfer ink layer is provided which at least presents the visco-elastic characteristics that tanδ is of 1 or more and the complex dynamic viscosity falls within 100 to 40,000 Pa.s in the viscoelasticity measurement with a frequency of 1 Hz in the linear viscoelastic region of temperature from 100 to 150° C. Alternatively, a thermal-transfer ink layer containing a coloring matter and a thermo-fusing resin is provided on a support, and the thermo-fusing resin presents the visco-elastic characteristics that tanδ is of 1.7 or more and the complex dynamic viscosity falls within 10 to 20,000 Pa.s in the viscoelasticity measurement with a frequency of 1 Hz in the linear viscoelastic region of temperature from 100 to 150° C.

9 Claims, No Drawings

THERMAL-TRANSFER RECORDING MEDIUM AND THERMAL TRANSFER RECORDING METHOD

TECHNICAL FIELD

The present invention relates to a thermal-transfer recording medium of which thermal-transfer ink layer on the support is transferred to a transfer medium with the help of a heater element such as a thermal head printer so as to form an image and also relates to a thermal-transfer recording method using this. In particular, the present invention is directed to a thermal-transfer recording medium and its thermal-transfer recording method whereby ink can be well transferred to a transfer medium such as plastic film etc. and the transferred image is excellent in resistance to mechanical abrasion, and wherein, when plural colors of thermal-transfer inks are printed in layers, the layers of the thermal transfer inks are highly transmissible to light, forming a well-ordered laminar structure and hence presenting excellent color reproduction.

BACKGROUND ART

Thermal-transfer recording methods using thermal heads have become widely used for a variety of utilities such as label printers, ticket venders, word processors etc. As the use has spread, the usage environment of the prints has become more severe than the environment under which they were conventionally used.

Further, as the usage environment of the prints has become more severe, types of transfer media used have diversified from paper as conventionally used to plastic films etc. which have less dependence on the environment. When the transfer material is atypical, conventional ribbons having a thermal-transfer ink composition mainly composed of waxes cannot provide satisfactory transfer of ink or the print tends to easily rub off due to a slight abrasion even after successful transfer, so that the print cannot provide satisfactory mechanical resistance to abrasion.

In particular, in the field of printed matter needing high-quality, posters, billboards etc., there are strict constraints on the reproducibility of colors and color unevenness of the transfer material, and no conventional thermal transfer ribbons can satisfy these requirements.

Further, concerning the conventional thermal transfer ribbons, in the case where color representation is made by repeated transfer operations of thermal-transfer ink layers onto the same transfer medium and when two or more repeated printings are made, the composition of the previously printed transfer ink layer will melt from heat from the thermal head when it makes a repeated printing operation because the viscosity of the conventional thermal transfer ink at the softening point or at the melting point is low. This melting causes color unevenness due to ink mixing and ink repellence, and deficiency in transfer itself in the worst case.

The countermeasures against these problems needed delicate mechanical and electrical controls as being effected by impregnating all the inks which are transferred multiple times into paper as transfer medium so as to produce a mixed state of inks for representation of colors, or by lowering the transfer energy on the printer side depending on the number of repetitions of transfer, i.e., the first, the second and the third, so as to maintain the transferability in a good state.

There has been another attempt in which in accordance with the number of repetitions of transfer and the order of transfer, the softening temperatures of the ink layers to be transferred are differentiated so as to attain both good transfer performance and reproducibility of colors.

These countermeasures are effective in the case where the transfer media is composed of a material such as paper and the like, but cannot exhibit satisfactory effects for materials being less absorptive such as a plastic base etc., during transfer of thermal transfer ink.

As stated above, the environment under which the thermally transferred prints produced by using thermal heads has become more severe than the environment under which the prints were conventionally used. Examples include use under severe room temperatures and use under an environment in which the prints are mechanically abraded.

Because of this tendency, special types of transfer media which are more hard-wearing have been used as already stated. This tendency requires good transfer to the plastic film etc., acquisition of printed matters having the required durability, and solving the problems of ink unevenness due to mixing of inks, repellence of ink, and weak fixing performance due to superimposition of inks when representation of colors is made by repeated transfer of thermal-transfer ink layers onto the same transfer medium.

Therefore, there is an important demand for a thermal-transfer recording medium meeting all the requirements such as being able to perform good transfer to transfer media having durability, such as plastic film, to provide prints having sufficient resistance to mechanical abrasion without causing color unevenness due to ink mixing or ink repellence when representation of colors is made by repeated transfer of thermal-transfer ink layers onto the same transfer medium, and to provide sufficient resistance to abrasion even when inks are layered. The important key to meeting this demand, was considered to reside in the constituents of the thermal-transfer recording medium, that is, the composition of the thermal-transfer ink layers in a so-called ink ribbon. Although the composition of transfer ink constituents has been studied conventionally, no proposal has been made yet which meets the level of the requirements of the invention. The object of the invention is to provide the method to solve this problem.

DISCLOSURE OF INVENTION

In order to solve the above problems, the inventors hereof have completed the present invention by providing a thermal-transfer ink layer having specified viscoelastic characteristics or a thermal-transfer ink layer at least comprising a coloring matter and a thermo-fusing resin having specified viscoelastic characteristics, onto a support.

Specifically, a thermal-transfer recording medium of the invention, at least comprises: a support; and a thermal-transfer ink layer provided on the support, wherein the thermal-transfer ink layer consists of an ink composition which is in a softened state within the temperature range of 100 to 150° C. and presents the following behaviors (A) and (B) in the viscoelasticity measurement with a frequency of 1 Hz in the linear viscoelastic region of temperature from 100 to 150° C:

(A) $\tan\delta$ is of 1 or more, (B) the complex dynamic viscosity falls within 100 to 40,000 Pa.s.

The thermal-transfer ink layer may contain a pigment and a vehicle, and the pigment is of an organic one.

Alternatively, the thermal-transfer ink layer may contain an inorganic pigment and a vehicle. In this case, the ratio of the refractive index Np of the inorganic pigment to the refractive index Nr of the vehicle needs to fall within the range of:

$$Np/Nr=1.00–1.12.$$

A thermal-transfer recording method of the invention uses a plurality of thermal-transfer ink layers, each consisting of an ink composition which is in a softened state within the temperature range of 100 to 150° C. and presents the following behaviors (A) and (B) in the viscoelasticity measurement with a frequency of 1 Hz in the linear viscoelastic region of temperature from 100 to 150° C.:

(A) tanδ is of 1 or more, (B) the complex dynamic viscosity falls within 100 to 40,000 Pa.s, and transfers each of the thermal-transfer ink layers superimposedly onto the transfer medium to perform multicolor printing.

The thermal-transfer ink layer may contain a pigment and a vehicle and the pigment is of an organic one to perform color printing.

Alternatively, the thermal-transfer ink layer may contain an inorganic pigment and a vehicle to perform color printing. In this case, the ratio of the refractive index Np of the inorganic pigment to the refractive index Nr of the vehicle needs to fall within the range of:

$$Np/Nr=1.00–1.12.$$

Further, a thermal-transfer recording medium of the invention, at least comprises: a support; and a thermal-transfer ink layer provided on the support, wherein the thermal-transfer ink layer contains a coloring matter and a thermo-fusing resin, and the thermo-fusing resin is in a softened state within the temperature range of 100 to 150° C. and presents the following behaviors (A) and (B) in the viscoelasticity measurement with a frequency of 1 Hz in the linear viscoelastic region of temperature from 100 to 150° C.:

(A) tanδ is of 1.7 or more, (B) the complex dynamic viscosity falls within 10 to 20,000 Pa.s.

The coloring matter may be of an organic pigment.

Alternatively, the coloring matter may at least comprise an inorganic pigment, and in this case, the ratio of the refractive index Np of the inorganic pigment to the refractive index Nr of the vehicle needs to fall within the range of:

$$Np/Nr=1.00–1.12.$$

In accordance with the above configurations, when the above thermal-transfer recording medium is used so that a plurality of colors are thermally transferred in layers onto a transfer medium such as a plastic base etc. using a thermal printer and the like, the transfer ink layers form a well-ordered laminar structure, which allows good superimpositional printing, and which also prevents the printed image from being rubbed off or damaged by a strong mechanical abrasion, thus maintaining the print in a good printed state.

BEST MODE FOR CARRYING OUT THE INVENTION

A thermal-transfer ink layer of the invention consists of an ink composition which is in a softened state within the temperature range of 100 to 150° C. and presents a tanδ value of 1 or more and a complex dynamic viscosity of 100 to 40,000 Pa.s in the viscoelasticity measurement with a frequency of 1 Hz in the linear viscoelastic region of temperature from 100 to 150° C.

In the thermal-transfer recording medium of the invention, when thermal-transfer ink layers are transferred in layers, the ink compositions form a well-ordered laminar structure and can provide a print without color unevenness due to ink mixing and without ink repellence even when representation of colors is made by repeated transfer of the thermal-transfer ink layers onto a single transfer medium of a plastic base.

The above thermal-transfer ink layer needs to be in its softened state in the whole range of temperatures from 100 to 150° C.

Those which will not be softened in all or part of this range of temperatures, more specifically, those which have such a high softening point that the solid state will be maintained on the lower side of the temperature range during heating, cannot be softened enough to be thermally transferred by the heat energy which is given from the printer during transfer, resulting in transfer insufficiency. This insufficiency of energy during transfer will cause bad adhesion to the print medium, and hence the print will rub off under trivial mechanical abrasion.

It is important that the ink composition constituting the thermal-transfer ink layer presents a tanδ value of 1 or more and a complex dynamic viscosity falling within the range from 100 to 40,000 Pa.s in the viscoelasticity measurement with a frequency of 1 Hz in the linear viscoelastic region of temperature from 100 to 150° C.

Here, the linear viscoelastic region defines the region where in the viscoelasticity measurement by a rheometer using a vibration method, when for example, a sinusoidal waveform force is exerted on a test piece and the conditions, such as torque, frequency, gaps in the measurement geometry, at the time of measurement are set appropriately, the phase shift to be detected is obtained as a stable continuous sinusoidal wave.

The value of the complex dynamic viscosity obtained here indicates a value relatively close to the viscosity obtained by the normal rotational method.

In the invention, a frequency of 1 Hz is used as the typical value in the measurement. The reason is that it is considered that the frequency range which can be assumed to be close to the behavior of an actual transfer operation is around 1 Hz.

In a viscoelasticity measurement, tanδ is a value obtained by dividing the loss elasticity by the storage elasticity, and when a test piece presents a large tanδ value, its physical property is determined to have a greater viscosity component whereas when a test piece presents a small tanδ value, the elasticity component is determined to be greater.

In the present invention, it is essential that tanδ is 1 or greater, or the ink composition presents the physical property of a relatively large visco-response. An ink composition having a physical property of tanδ being 1 or greater when it is heated and softened, can provide a good transfer performance when the ink is transferred to a transfer medium such as plastic film etc., which is thought as being hard to transfer ink thereto, or when there is some insufficiency in the transfer energy. In particular, when thermal-transfer ink layers are repeatedly transferred in layers to a single transfer medium in order to achieve reproduction of colors, the transferred ink layers form a well-ordered laminar structure without repelling one another, thus providing good printing excellent in resistance to abrasion in layeredly printed matter.

Conversely, when an ink has a tanδ value of lower than 1, the elasticity response becomes too great and hence it is impossible for the ink to have a high enough fluidity to perform good transfer when it is transferred, so that the tendency toward transfer failure increases. Even if transfer could be performed, transfer media capable of having ink transferred thereon and the range of the printing energy would be limited, causing problems.

Further, the ink composition of the invention is required to have a complex dynamic viscosity of 100 to 40,000 Pa.s when its viscoelasticity is measured within the temperature range of 100° C. to 150° C. When it falls within this range, the transferred ink layers form a well-ordered laminar structure even when the ink is directly transferred onto the transfer medium, making it possible to obtain good transfer performance. Also, when colors are represented by superimposing the thermal-transfer ink layers by repetitions of transfer, all the layers form a well-ordered laminar structure. Therefore, without causing color unevenness due to ink mixing, or ink repellence when transfer ink layers previously printed melt from heat from the thermal head during superimpositional printing, it is possible to perform layered multi-color printing which is still excellent in resistance to abrasion. The complex dynamic viscosity more preferably falls within 300 to 30,000 Pa.s.

On the other hand, when the viscosity falls below this range, the fluidity during heating and fusing becomes too great, so that the thermal-transfer ink layer after transfer cannot be formed in a well-ordered laminar structure because of the transfer force during transfer, thus producing unpreferred color densities and color unevenness. Further, in the case where colors are reproduced by superimposing the thermal-transfer ink layers, the ink layer existing at areas to which another ink is transferred does not form a well-ordered laminar structure, having irregularities, hence it is difficult to perform good thermal transfer over it. Moreover, heat from the thermal head during superimpositional printing, undesirably fluidizes the composition of the previously printed transfer ink layer, causing color unevenness and/or ink repellence due to ink mixing as well as alleviating the resistance to abrasion after superimpositional printing.

When the viscosity falls above this range, it is impossible to make the ink composition as fluid as is required for thermal transfer during heating and fusing, thus the tendency toward transfer failure increases. Even if transfer could be performed, transfer media capable of having ink transferred thereon would be limited or a large printing energy would be needed giving rise to undesirable problems.

In the present invention, the thermal-transfer ink layer is adjusted so as to have the above physical properties, and can be configured to be of a coloring matter and an appropriate binder having physical properties suited to the above physical properties, or can be prepared so that the whole ink layer including various additives meets the requirements. Further, to configure a thermal-transfer ink layer having excellent performances, its components also need to be considered.

The thermal-transfer ink layer of the invention preferably at least includes a pigment and a vehicle. Examples of the pigment in use include carbon black, ultramarine, chrome yellow, cadmium yellow, Hansa Yellow, disazo yellow, Permanent Red, Alizarine lake, quinacridone red, Benzimidazolone red, Victoria Blue lake, Phthalocyanine Blue, Phthalocyanine Green, dioxadinazole violet. From these, one or two of them can be used. Pigments preferably have light resistance to deal with the usage of the prints in an ultraviolet-rich environment such as exposure outdoors, and the thermal-transfer ink layer itself preferably has some mechanical strength.

Since in the thermal-transfer recording medium of the invention, each thermal-transfer ink layer to be transferred has a good light transmittance, it is possible to obtain a print having markedly excellent color reproduction, at the areas where transfer materials are laid over one another.

If the pigment is of an organic one, the pigment itself has a high light transmittance. Therefore, when colors are reproduced by superimposing the thermal-transfer ink layers by repetitions of transfer, it is possible to correctly reproduce the color tones of individual layers, and hence superimposed areas can be represented by a balanced and correct color mixture of the color layers by a subtractive or additive color process so as to reproduce various chromatic colors.

If the pigment is of an inorganic one, some have bad light transmittance. With such a pigment, it not easy to make a multi-layered color print of good quality. When an inorganic pigment is used, it is possible to perform satisfactory multi-color printing using the combination of a pigment and a vehicle wherein the ratio of the refractive index Np of the inorganic pigment to the refractive index Nr of the vehicle falls within the range of:

$$Np/Nr=1.00-1.12.$$

If the difference between the two refractive indices is greater than this range, the transmittance of light degrades. More specifically, the obscuring power of the thermal-transfer ink layer is too great, so that in the case where a color is reproduced by superimposing the thermal-transfer ink layers by repetitions of transfer, the outer ink layers hide the colors of the previously transferred ink layers. Therefore, it becomes impossible to correctly reproduce the colors of the ink layers previously transferred, so that a correct mixture of colors cannot be obtained from the subtractive color process. Thus, this large difference is unpreferred because desired multi-colors cannot be obtained.

The vehicle of the thermal-transfer recording medium of the invention can employ various resins or waxes. These can be used alone or compounded in combination. Each component of the plural thermal-transfer ink layers used for the thermal-transfer recording method of the invention may be made up of different compositions or the same composition. In view of control of the thermal sensitivity, or in respect of the coating process, it is preferable that the inks for all the layers are made up of the same type of composition.

The resin components used in the invention can be made up of thermo-fusing resins such as polyvinyl chloride resin, polyamide resin, polyvinyl alcohol resin, acrylic resin, polyester resin, polyethylene resin, epoxy resin, chlorinated polypropylene resin, vinyl chloride/vinyl acetate/hydroxy acrylate copolymer, vinyl chloride/vinyl acetate/vinyl alcohol copolymer, styrene/acrylic copolymer, ethylene/methacrylic acid/acrylic acid copolymer, ethylene/vinyl acetate copolymer, ethylene/ethyl acrylate copolymer, polystyrene/polyisoprene copolymer, terpene resin, rosin and its derivatives, phenol resin, petroleum resins, xylene resin.

Examples of the waxes used in the invention include: natural or synthesized waxes such as paraffin wax, candelilla wax, micro-crystalline wax, polyethylene wax, bees wax, carnauba wax, spermaceti, haze wax, rice bran wax, montan wax, ozocerite, ceresine, ester wax, Fischer-tropsch wax, etc.; higher fatty acid waxes such as myristic acid, palmitic acid, stearic acid, fromen acid, behenic acid, lauric acid, margaric acid etc.; and amide waxes such as stearamide, oleic amide etc.

When a plurality of the above-described thermal-transfer recording media of the invention are used so as to reproduce colors by superimposing the thermal-transfer ink layers by repetitions of transfer, it is possible to correctly perform a thermal-transfer recording method of the invention.

The thermo-fusing resin contained in the thermal-transfer ink layer of the invention is in its softened state within the temperature range of 100 to 150° C., and has physical properties presenting a tanδ value of 1.7 or more and a complex dynamic viscosity of 10 to 20,000 Pa.s in the viscoelasticity measurement with a frequency of 1 Hz in the linear viscoelastic region of temperature from 100 to 150° C.

Accordingly, in accordance with the thermal-transfer recording medium of the invention using the above thermo-fusing resin, when the thermal-transfer ink layers are transferred in layers, all the ink compositions form a well-ordered laminar structure. Even when, with use of a single plastic base as a transfer medium, colors are reproduced by superimposing the thermal-transfer ink layers by repetitions of transfer, it is possible to obtain prints without causing any color unevenness due to ink mixing or ink repellence.

The thermal-transfer recording medium of the invention needs to contain a thermo-fusing resin which will be in its softened state throughout the temperature range of 100 to 150° C. Those which will not be in their softened state in all or part of this temperature range, or those which have such a high softening point that the solid state will be maintained on the lower side of the temperature range during heating, cannot be softened enough to be thermally transferred by the heat energy which is given from the printer during transfer, resulting in transfer insufficiency. This insufficiency of energy during transfer will cause bad adhesion between the printing material and print medium, and the print will rub off under trivial mechanical abrasion.

It is important that the thermo-fusing resin contained the thermal-transfer ink layer presents a tanδ value of 1.7 or more and a complex dynamic viscosity falling within the range from 10 to 20,000 Pa.s in the viscoelasticity measurement with a frequency of 1 Hz in the linear viscoelastic region range from temperatures of 100 to 150° C.

In the present invention, it is essential that tanδ is 1.7 or greater, or the ink composition contains a thermo-fusing resin presenting a relatively large visco-response. An ink composition containing a thermo-fusing resin presenting the physical property of tanδ being 1.7 or greater when it is heated and softened, can provide a good transfer performance when the ink is transferred to a transfer medium such as plastic film etc., which is considered as being hard to transfer ink thereto, or when there is some insufficiency in the transfer energy. In particular, when thermal-transfer ink layers are repeatedly transferred in layers to a single transfer medium in order to achieve reproduction of colors, the transferred ink layers form a well-ordered laminar structure without repelling one another, thus providing good printing excellent in resistance to abrasion in layeredly printed matter.

Conversely, when an ink has a tanδ value of lower than 1.7, the elasticity resistance becomes too great and hence it is impossible for the ink to have a high enough fluidity to perform good transfer when it is transferred, so that the tendency toward transfer failure increases. Even if transfer could be performed, the transfer media capable of having ink transferred thereon and the range of the printing energy would be limited, causing problems. Tanδ is more preferably 3 or more.

Further, the thermo-fusing resin used in the invention is required to have a complex dynamic viscosity of 10 to 20,000 Pa.s when its viscoelasticity is measured within the temperature range of 100° C. to 150° C. When it falls within this range, the transferred ink layers form a well-ordered laminar structure even when the ink is directly transferred onto the transfer medium, making it possible to obtain good transfer performance. Also, when colors are represented by superimposing the thermal-transfer ink layers by repetitions of transfer, all the layers form a well-ordered laminar structure. Therefore, without causing color unevenness due to ink mixing, or ink repellence when transfer ink layers previously printed melt from heat from the thermal head during superimpositional printing, it is possible to perform layered multi-color printing which is still excellent in resistance to abrasion. The complex dynamic viscosity more preferably falls within 20 to 5,000 Pa.s.

On the other hand, when the viscosity falls below this range, the fluidity during heating and fusing becomes too great, so that the thermal-transfer ink layer after transfer cannot be formed in a well-ordered laminar structure by the transfer force during transfer, thus producing unpreferred color densities and color unevenness. Further, in the case where colors are reproduced because of superimposing the thermal-transfer ink layers, the ink layer existing at areas to which another ink is transferred will not form a well-ordered laminar structure, having irregularities, hence it is difficult to perform good thermal transfer over it. Moreover, heat from the thermal head during superimpositional printing, undesirably fluidizes the composition of the previously printed transfer ink layer, causing color unevenness and/or ink repellence due to ink mixing as well as alleviating the resistance to abrasion after superimpositional printing.

When the viscosity falls above this range, it is impossible to make the ink composition as fluid as is required for thermal transfer during heating and fusing, thus the tendency toward transfer failure increases. Even if transfer could be performed, transfer media capable of having ink transferred thereon would be limited and/or a large printing energy is needed, thus giving rise to undesirable problems.

Specific examples of the thermo-fusing resin meeting the above requirements of physical properties include: polyvinyl chloride resin, polyamide resin, polyvinyl alcohol resin, acrylic resin, polyester resin, polyethylene resin, epoxy resin, chlorinated polypropylene resin, vinyl chloride/vinyl acetate/hydroxy acrylate copolymer, vinyl chloride/vinyl acetate/vinyl alcohol copolymer, ethylene/methacrylic acid/acrylic acid copolymer, ethylene/vinyl acetate copolymer, ethylene/ethyl acrylate copolymer, polystyrene/polyisoprene copolymer.

Some waxes can be added to the thermal-transfer ink layer together with the above thermo-fusing resin. Examples of waxes to be added include: natural or synthesized waxes such as paraffin wax, candelilla wax, micro-crystalline wax, polyethylene wax, bees wax, carnauba wax, spermaceti, haze wax, rice bran wax, montan wax, ozocerite, ceresine, ester wax, Fischer-tropsch wax, etc.; higher fatty acid waxes such as myristic acid, palmitic acid, stearic acid, FROMEN acid, behenic acid, lauric acid, margaric acid etc.; and amide waxes such as stearamide, oleic amide etc.

In the present invention, the thermal-transfer ink composition is prepared using a thermo-fusing resin having the aforementioned physical properties, and can be added with other resins and various additives etc. within the range that will not affect the performances of the thermo-fusing resin. Further, to form a thermal-transfer ink layer having excellent performances, its components also need to be considered.

The thermal-transfer ink layer of the invention is composed of at least a coloring matter and a thermo-fusing resin. As the coloring matter, its pigment preferably has light resistance to deal with the usage of the print in an ultraviolet rays-rich environment such as exposure outdoors, and the thermal-transfer ink layer itself also has some good mechanical strength. These features are advantageous.

Examples of the pigment in use for the invention include carbon black, ultramarine, chrome yellow, cadmium yellow, Hansa Yellow, disazo yellow, Permanent Red, Alizarine lake, quinacridone red, Benzimidazolone red, Victoria Blue lake, Phthalocyanine Blue, Phthalocyanine Green, dioxadinazole violet. From these, one or two or more of them can be used.

Since in the thermal-transfer recording medium of the invention, each thermal-transfer ink layer to be transferred has a good light transmittance, it is possible to obtain a print having markedly excellent color reproduction, at the areas where transfer materials are laid over one another.

If the pigment is of an organic one, the pigment itself has a high light transmittance. Therefore, when colors are reproduced by superimposing the thermal-transfer ink layers by repetitions of transfer, it is possible to correctly reproduce the color tones of individual layers, and hence superimposed areas can be represented by a balanced and correct color mixture of the color layers by a subtractive or additive color process so as to reproduce various chromatic colors.

If the pigment is of inorganic one, some have bad light transmittance. With such a pigment, it not easy to make a multi-layered color print of good quality. When an inorganic pigment is used, the ratio of the refractive index Np of the inorganic pigment to the refractive index Nr of the vehicle needs to fall within the range of:

$$Np/Nr=1.00-1.12.$$

It is possible to perform good multi-color printing using the combination of a pigment and a vehicle which falls within this range.

If the difference between the two refractive indices is greater than this range, the transmittance of light degrades. More specifically, the obscuring power of the thermal-transfer ink layer is too great, so that in the case where colors are reproduced by superimposing the thermal-transfer ink layer by repetitions of transfer, the outer ink layers hide the colors of the previously transferred ink layers. Therefore, it becomes impossible to correctly reproduce the colors of the ink layers previously transferred, so that a correct mixture of colors cannot be obtained from the subtractive color process. Thus, this large difference is unpreferred because desired multi-colors cannot be obtained.

When the thermal-transfer recording medium of the invention is used for layered printing, Each component of the plural thermal-transfer ink layers used may be made up of different compositions or the same composition. In view of control of the thermal sensitivity, or in respect of the coating process, it is preferable that the inks for all the layers are made up of the same type of composition.

Now, the thermal-transfer recording medium of the invention and the method of thermal transfer recording will be illustratively explained.

As the support for the thermal-transfer recording medium, various plastic films of known types can be used. The thermal-transfer recording medium of the invention may employ a polyester film of about 2.5 to 6.0 μm thick with a heat-resistant smoothing layer provided on the rearside thereof.

The thermal-transfer recording medium of the invention, is composed by providing the above-described thermal-transfer ink layer on the support. The manufacturing method of the ink layer is not particularly specified. It is possible to obtain the thermal-transfer recording medium by dispersing the ink layer component into a water-based or oil-based solvent and dissolving it to prepare an application liquid, and applying it to the predetermined coating thickness by a coating method using a gravure coater, wire-bar coater, air-knife coater etc.

Informing the thermal-transfer ink layer on the support, a single color of thermal transfer ink may be applied over the whole surface of the support to produce a mono-color ribbon. Alternatively, plural colors of transfer ink layers may be formed successively in sections.

In order to implement the thermal-transfer recording method of the invention, the thermal-transfer recording medium of the invention described above is used. When a plurality of the thermal-transfer recording media of the invention are used to implement multiple color layered printing, the printing is performed in the following manner. In the case where printing is performed by a single head with mono-color ribbons wherein a single color of thermal transfer ink is applied over the whole surface of the support, the operation is implemented by printing with the first ribbon, changing the ribbon, retracting the transfer medium which has been once printed thereon, and then printing with the second ribbon. When three or more colors are printed, the same operation is sequentially repeated to achieve multi-color thermal transfer recording.

When the ribbon wherein plural colors of transfer ink layers are formed successively in sections is used, a dedicated printer is used but it is possible to easily perform multi-color printing without the necessity of changing the ribbon.

For the thermal-transfer ink composition of the invention, in order to improve various performances such as abrasion resistance of the print, feeding performance of the ribbon, conservation performance of ribbon etc., certain additives can be blended therein within the range where it does not degrade the basic performances of the invention. The added amount varies depending upon the type of the additive, but is preferably equal to or lower than 20% by weight relative to the total amount of the thermal transfer ink.

The coating thickness of the thermal-transfer ink layer is preferably about 1.0 to 3.0 μm in order to ensure good reproduction of colors including layered printing.

The thermal-transfer recording medium of the invention should essentially have a thermal-transfer ink layer on the support, and may be added with other layers, e.g., a functional layer such as a separation layer between the support and thermal-transfer ink layer.

EMBODIMENTS

Now, the present invention will be described in detail by explaining embodiments, but the present invention should not be limited to the following embodiments. In the description of the following example and comparative examples, 'parts' is represented based on weight without specifying any particular unit.

EXAMPLE 1

A support was produced by forming a heat resistant smoothing layer on one side of polyester film of 4.5 μm thick. A thermal-transfer ink layer component having the following compositions was prepared in a toluene methyl ethyl ketone (ratio 5:5) solvent so that it contained a solid component of 30%. This was applied to the opposite side of the support to the heat resistant smoothing layer, by a gravure coater to a coating thickness of 2.0 μm, and dried, thus forming a black thermal-transfer ink layer.

The Thermal-transfer Ink Layer Composition vinyl chloride/vinyl acetate/hydroxy acrylate copolymer

| | |
|---|---|
| (note 1) | 60 parts |
| polyethylene wax (note 2) | 15 parts |
| carbon black | 20 parts |
| dispersant | 5 parts |

(note 1)
glass transition point: 53° C.,
molecular weight: 5,500
(note 2)
polyethylene oxide wax having a melting point of 110° C.

The values of this thermal-transfer ink layer measured on viscoelasticity at temperatures from 100 to 150° C. were:

tan δ=2.12 to 2.59 complex dynamic viscosity=1,300 to 10,800 Pa.s

EXAMPLE 2

In a similar manner to example 1, a thermal-transfer ink layer component having the following compositions was formed on the support to prepare a thermal-transfer ink layer of cyan, thus a thermal-transfer recording medium was produced.

The Thermal-transfer Ink Layer Composition

| | |
|---|---|
| polyester resin (note 3) | 60 parts |
| polyethylene wax (note 2) | 15 parts |
| phthalocyanine blue (organic pigment) | 20 parts |
| dispersant | 5 parts |

(note 3)
glass transition point: 55° C.,
molecular weight: 5,000

The values of this thermal-transfer ink layer measured on viscoelasticity at temperatures from 100 to 150° C. were:

tan δ=1.48 to 2.88 complex dynamic viscosity=630 to 30,000 Pa.s

EXAMPLE 3

In a similar manner to example 1, a thermal-transfer ink layer component having the following compositions was formed on the support to prepare a thermal-transfer ink layer of magenta, thus a thermal-transfer recording medium was produced.

The Thermal-transfer Ink Layer Composition

| | |
|---|---|
| polyester resin (note 3) | 60 parts |
| polyethylene wax (note 2) | 15 parts |
| quinacridone red (organic pigment) | 8 parts |
| Benzimidazolone red (organic pigment) | 12 parts |
| dispersant | 5 parts |

The values of this thermal-transfer ink layer measured on viscoelasticity at temperatures from 100 to 150° C. were:

tan δ=1.48 to 2.88 complex dynamic viscosity=630 to 30,000 Pa.s

EXAMPLE 4

In a similar manner to example 1, a thermal-transfer ink layer component having the following compositions was formed on the support to prepare a thermal-transfer ink layer of yellow, thus a thermal-transfer recording medium was produced.

The Thermal-transfer Ink Layer Composition

| | |
|---|---|
| polyester resin (note 3) | 60 parts |
| polyethylene wax (note 2) | 15 parts |
| disazo yellow (organic pigment) | 20 parts |
| dispersant | 5 parts |

The values of this thermal-transfer ink layer measured on viscoelasticity at temperatures from 100 to 150° C. were:

tan δ=1.48 to 2.88 complex dynamic viscosity=630 to 30,000 Pa.s

EXAMPLE 5

In a similar manner to example 1, a thermal-transfer ink layer component having the following compositions was formed on the support to prepare a thermal-transfer ink layer of blue, thus a thermal-transfer recording medium was produced.

The Thermal-transfer Ink Layer Composition vinyl chloride/vinyl acetate/hydroxy acrylate copolymer

| | |
|---|---|
| (note 1) | 65 parts |
| polyethylene wax (note 2) | 10 parts |
| ultramarine (note 4) | 20 parts |
| dispersant | 5 parts |

(note 4)
Inorganic pigment, refractive index (Np) = 1.56
Refractive index of the vehicle (Nr) = 1.53
Np/Nr = 1.02.

The values of this thermal-transfer ink layer measured on viscoelasticity at temperatures from 100 to 150° C. were:

tan δ=2.92 to 3.47 complex dynamic viscosity=700 to 10,000 Pa.s

EXAMPLE 6

In a similar manner to example 1, a thermal-transfer ink layer component having the following compositions was formed on the support to prepare a thermal-transfer ink layer of violet, thus a thermal-transfer recording medium was produced.

The Thermal-transfer Ink Layer Composition vinyl chloride/vinyl acetate/hydroxy acrylate copolymer

| | |
|---|---|
| (note 1) | 55 parts |
| polyethylene wax (note 2) | 10 parts |
| dioxadinazole violet (organic pigment) | 20 parts |
| extender (note 5) | 10 parts |
| dispersant | 5 parts |

(note 5)
Calcium carbonate powder (inorganic pigment), refractive index (Np) = 1.60
Refractive index of the vehicle (Nr) = 1.53
Np/Nr = 1.05.

The values of this thermal-transfer ink layer measured on viscoelasticity at temperatures from 100 to 150° C. were:

tan δ=2.00 to 2.60 complex dynamic viscosity=1,500 to 12,000 Pa.s

Comparative Example 1

In a similar manner to example 1, a thermal-transfer ink layer component having the following compositions was formed on the support to prepare a thermal-transfer ink layer of blue, thus a thermal-transfer recording medium was produced.

| | |
|---|---|
| styrene/acrylic copolymer (note 6) | 10 parts |
| coumarone resin (note 7) | 25 parts |
| polyethylene wax (note 2) | 20 parts |
| carnauba wax | 20 parts |
| phthalocyanine blue (organic pigment) | 20 parts |
| dispersant | 5 parts |

(note 6)
glass transition point: 57° C.,
molecular weight: 1,600
(note 7)
softening point: 100° C.,
molecular weight: 640

The values of this thermal-transfer ink layer measured on viscoelasticity at temperatures from 100 to 150° C. were:

tan δ=1.70 to 11.4 complex dynamic viscosity=5 to 15 Pa.s

Comparative Example 2

In a similar manner to example 1, a thermal-transfer ink layer component having the following compositions was formed on the support to prepare a thermal-transfer ink layer of blue, thus a thermal-transfer recording medium was produced.
vinyl chloride/vinyl acetate/vinyl alcoholic copolymer

| | |
|---|---|
| (note 8) | 65 parts |
| polyethylene wax (note 2) | 10 parts |
| phthalocyanine blue (organic pigment) | 20 parts |
| dispersant | 5 parts |

(note 8)
glass transition point: 70° C.,
molecular weight: 20,000

The values of this thermal-transfer ink layer measured on viscoelasticity at temperatures from 100 to 150° C. were:

tan δ=0.26 to 1.40 complex dynamic viscosity=7,000 to 60,000 Pa.s

Comparative Example 3

In a similar manner to example 1, a thermal-transfer ink layer component having the following compositions was formed on the support to prepare a thermal-transfer ink layer of blue, thus a thermal-transfer recording medium was produced.
vinyl chloride/vinyl acetate/hydroxy acrylate copolymer

| | |
|---|---|
| (note 9) | 65 parts |
| polyethylene wax (note 2) | 10 parts |
| phthalocyanine blue (organic pigment) | 20 parts |
| dispersant | 5 parts |

(note 9)
glass transition point: 65° C.,
molecular weight: 15,000

The values of this thermal-transfer ink layer measured on viscoelasticity at temperatures from 100 to 150° C. were:

tan δ=0.53 to 8.10 complex dynamic viscosity=4,300 to 71,000 Pa.s

EXAMPLE 7

The thermal transfer inks, cyan, magenta and yellow, prepared in the above examples 2, 3 and 4, were sequentially coated separately, in sections, to the same support as used in each of the examples, using a gravure coater so as to obtain a three-color thermal-transfer recording medium.

EXAMPLE 8

The thermal-transfer recording medium obtained in example 2 was set in a thermal transfer printer and used to perform printing onto a white polyester label under the printing conditions of 8 dot/mm, 0.2–0.4 mj/dot and 2 inch/min. Then the thermal-transfer recording medium obtained in example 3 was used to perform printing superimposedly on the same label, to thereby produce a multi-color print.

EXAMPLE 9

The thermal-transfer recording media obtained in examples 2, 3 and 4 were set in a multi-head thermal transfer printer having three printing heads and used to perform superimpositional printing of the individual ink layers onto a white polyester label under the printing conditions of 8 dot/mm, 0.2–0.4 mj/dot and 2 inch/min, to thereby produce a multi-color print.

EXAMPLE 10

The thermal-transfer recording medium, obtained in example 7 was set in a thermal transfer printer for multi-color printing, the cyan ink layer section was printed onto a white polyester label under the printing conditions of 8 dot/mm, 0.2–0.4 mj/dot and 2 inch/min. Then, the label was rewound so that the magenta ink layer section was printed superimposedly in part over the cyan print. Again, the label was rewound so that the yellow ink layer section was printed so as to be partially laid over the printed ink layers, to thereby produce a multi-color print on the same label.

Each of the thermal-transfer recording media thus prepared was set in a thermal transfer printer. Using transfer media such as a white polyester label, vinyl chloride label, YUPO label, peach-coat label, silver naming label, printing, including random superimpositional printing, was performed with each of the thermal-transfer recording media under the printing conditions of 8 dot/mm, 0.2 to 0.4 mj/dot and 2 inch/min, so as to produce a print. The results of printing are shown in Table 1.

TABLE 1

| | | | In superimpositional printing | | |
|---|---|---|---|---|---|
| | | 1st transfer performance | Transfer performance | Color reproducibility | Abrasion resistance |
| Ex. 1 | tan δ = 2.12–2.59<br>Complex dynamic viscosity = 1,300–10,800 Pa's | A | A | — | A |
| Ex. 2 | tan δ = 1.48–2.88<br>Complex dynamic viscosity = 630–30,000 Pa's | A | A | A | A |
| Ex. 3 | tan δ = 1.48–2.88<br>Complex dynamic viscosity = 630–30,000 Pa's | A | A | A | A |

TABLE 1-continued

| | | 1st transfer performance | In superimpositional printing: Transfer performance | In superimpositional printing: Color reproducibility | Abrasion resistance |
|---|---|---|---|---|---|
| Ex. 4 | tan δ = 1.48–2.88 Complex dynamic viscosity = 630–30,000 Pa's | A | A | A | A |
| Ex. 5 | tan δ = 3.47–2.92 Complex dynamic viscosity = 700–10,000 Pa's | A | A | A | A |
| Ex. 6 | tan δ = 2.00–2.60 Complex dynamic viscosity = 1,500–12,000 Pa's | A | A | A | A |
| Ex. 7 | — | A | A | A | A |
| Ex. 8 | — | A | A | A | A |
| Ex. 9 | — | A | A | A | A |
| Ex. 10 | — | A | A | A | A |
| CEx. 1 | tan δ = 1.70–11.4 Complex dynamic viscosity = 5–15 Pa's | B | C | C | C |
| CEx. 2 | tan δ = 0.26–1.40 Complex dynamic viscosity = 7,000–60,000 Pa's | C | C | C | A |
| CEx. 3 | tan δ = 3.00–12.00 Complex dynamic viscosity = 4,300–71,000 Pa's | C | C | C | A |

Evaluations were made on the first transfer performance of the first printing, the transfer performance and color reproducibility of the superimpositional print, and abrasion resistance of the print, by the following estimating methods.

The first transfer performance: after printing onto a blank transfer medium using a thermal transfer printer, the print was visually observed using a microscope with a magnifying power of 50 to check whether the print pattern was transferred exactly.

The transfer performance of the superimpositional print: after printing over the thermal transfer ink on a transfer medium with ink having already been thermally transferred thereon, the print was visually observed using a microscope with a magnifying power of 50 to check whether the print pattern was transferred exactly.

The color reproducibility in the superimpositional print: after printing over the thermal transfer ink on a transfer medium with ink having already been thermally transferred thereon, the print was visually checked to see whether the desired colors were reproduced by a subtractive color mixing process and whether color unevenness was present.

The abrasion resistance of the print: after printing had been implemented in a thermal transfer printer, the resultant print was reciprocatingly abraded one-hundred times using a 1 cm square piece of felt with ϕ2 mm steel ball being urged thereon with a load of 200 g. After this, the state of the print was observed.

As apparent from Table 1, the prints obtained by the thermal-transfer recording media of the invention shown in examples 1–6 and the prints obtained by the printing methods of examples 7–10 are all excellent in the first transfer performance and satisfactory in the transfer performance and color reproducibility of superimpositional printing as well as being excellent in abrasion resistance.

In contrast, the print obtained by the thermal-transfer recording medium of comparative example 1, was not of good quality, presenting weakness in abrasion resistance as well as having transfer defects and transfer unevenness in the first transfer performance estimation. Concerning the transfer performance and color reproducibility of superimpositional printing, when overlapping printing was attempted on the top of these transferred ink layers, the ink layers fused, resulting in color unevenness due to ink mixing and transfer failure due to ink repellence.

Concerning the thermal-transfer recording media of comparative examples 2 and 3, the transfer performance was bad because the elasticity response was too high during heating. The abrasion resistance in areas where transfer could be done was relatively fair only.

EXAMPLE 11

In a similar manner to example 1, a thermal-transfer ink layer component having the following compositions was formed on the support to prepare a thermal-transfer ink layer of black, thus a thermal-transfer recording medium was produced.

The Thermal-transfer Ink Layer Composition

| | |
|---|---|
| polyester resin (note 9) | 75 parts |
| carbon black | 20 parts |
| dispersant | 5 parts |

(note 9)
glass transition point: 55° C.,
molecular weight: 5,000

The values of the polyester resin measured on viscoelasticity at temperatures from 100 to 150° C. were:

tan δ=3.00 to 57.0 complex dynamic viscosity=95 to 13,400 Pa.s

EXAMPLE 12

In a similar manner to example 1, a thermal-transfer ink layer component having the following compositions was formed on the support to prepare a thermal-transfer ink layer of cyan, thus a thermal-transfer recording medium was produced.

The Thermal-transfer Ink Layer Composition

| | |
|---|---|
| polyester resin (note 9) | 60 parts |
| polyethylene wax (note 2) | 15 parts |
| phthalocyanine blue (organic pigment) | 20 parts |
| dispersant | 5 parts |

EXAMPLE 13

In a similar manner to example 1, a thermal-transfer ink layer component having the following compositions was formed on the support to prepare a thermal-transfer ink layer of magenta, thus a thermal-transfer recording medium was produced.

The Thermal-transfer Ink Layer Composition vinyl chloride/vinyl acetate/hydroxy acrylate copolymer

| | |
|---|---|
| (note 10) | 60 parts |
| polyethylene wax (note 2) | 15 parts |
| quinacridone red (organic pigment) | 8 parts |
| Benzimidazolone red (organic pigment) | 12 parts |
| dispersant | 5 parts |

-continued (note 10)
glass transition point: 53° C.
molecular weight: 5,500

The values of the copolymer measured on viscoelasticity at temperatures from 100 to 150° C. were:

tan δ=3.2 to 19.0 complex dynamic viscosity=37 to 3,800 Pa.s

EXAMPLE 14

In a similar manner to example 1, a thermal-transfer ink layer component having the following compositions was formed on the support to prepare a thermal-transfer ink layer of yellow, thus a thermal-transfer recording medium was produced.

The Thermal-transfer Ink Layer Composition

| | |
|---|---|
| polyester resin (note 9) | 60 parts |
| polyethylene wax (note 2) | 15 parts |
| disazo yellow (organic pigment) | 20 parts |
| dispersant | 5 parts |

EXAMPLE 15

In a similar manner to example 1, a thermal-transfer ink layer component having the following compositions was formed on the support to prepare a thermal-transfer ink layer of blue, thus a thermal-transfer recording medium was produced.

The Thermal-transfer Ink Layer Composition vinyl chloride/vinyl acetate/hydroxy acrylate copolymer

| | |
|---|---|
| (note 10) | 65 parts |
| polyethylene wax (note 2) | 10 parts |
| ultramarine (note 11) | 20 parts |
| dispersant | 5 parts |

(note 11)
Inorganic pigment, refractive index (Np) = 1.56
Refractive index of the vehicle (Nr) = 1.53
Np/Nr = 1.02.

EXAMPLE 16

In a similar manner to example 1, a thermal-transfer ink layer component having the following compositions was formed on the support to prepare a thermal-transfer ink layer of violet, thus a thermal-transfer recording medium was produced.

The Thermal-transfer Ink Layer Composition vinyl chloride/vinyl acetate/hydroxy acrylate copolymer

| | |
|---|---|
| (note 10) | 55 parts |
| polyethylene wax (note 2) | 10 parts |
| dioxadinazole violet (organic pigment) | 20 parts |
| extender (note 12) | 10 parts |
| dispersant | 5 parts |

(note 12)
Calcium carbonate powder (inorganic pigment), refractive index (Np) = 1.60
Refractive index of the vehicle (Nr) = 1.53
Np/Nr = 1.05.

Comparative Example 4

In a similar manner to example 1, a thermal-transfer ink layer component having the following compositions was formed on the support to prepare a thermal-transfer ink layer of black, thus a thermal-transfer recording medium was produced.

vinyl chloride/vinyl acetate/vinyl alcoholic copolymer

| | |
|---|---|
| (note 13) | 60 parts |
| polyethylene wax (note 2) | 15 parts |
| carbon black | 20 parts |
| dispersant | 5 parts |

(note 13)
glass transition point: 70° C.,
molecular weight: 20,000

The values of the copolymer measured on viscoelasticity at temperatures from 100 to 150° C. were:

tan δ=0.26 to 1.4 complex dynamic viscosity=3,180 to 21,800 Pa.s

Comparative Example 5

In a similar manner to example 1, a thermal-transfer ink layer component having the following compositions was formed on the support to prepare a thermal-transfer ink layer of blue, thus a thermal-transfer recording medium was produced.

vinyl chloride/vinyl acetate/hydroxy acrylate copolymer

| | |
|---|---|
| (note 14) | 60 parts |
| polyethylene wax (note 2) | 15 parts |
| phthalocyanine blue (organic pigment) | 20 parts |
| dispersant | 5 parts |

(note 14)
glass transition point: 70° C.,
molecular weight: 20,000

The values of the copolymer measured on viscoelasticity at temperatures from 100 to 150° C. were:

tan δ=0.53 to 8.1 complex dynamic viscosity=430 to 36,500 Pa.s

Comparative Example 6

In a similar manner to example 1, a thermal-transfer ink layer component having the following compositions was formed on the support to prepare a thermal-transfer ink layer of black, thus a thermal-transfer recording medium was produced.

| | |
|---|---|
| terpene resin (note 15) | 50 parts |
| ethylene/vinyl acetate copolymer (note 16) | 15 parts |
| polyethylene wax (note 2) | 10 parts |
| carbon black | 20 parts |
| dispersant | 5 parts |

(note 15)
glass transition point: 28° C.,
molecular weight: 630

The values of the terpene resin measured on viscoelasticity at temperatures from 100 to 150° C. were:

tan δ=11.4 to 57.2 complex dynamic viscosity=0.8 to 20 Pa.s (note 16) glass transition point: −31° C.,
molecular weight: 14,000

The values of the copolymer measured on viscoelasticity at temperatures from 100 to 150° C. were:

tan δ=3.1 to 6.8 complex dynamic viscosity=50 to 210 Pa.s

EXAMPLE 17

The thermal transfer inks, cyan, magenta and yellow, prepared in the above examples 12, 13 and 14, were sequentially coated separately, in sections, to the same support as used in each of the examples, using a gravure coater so as to obtain a three-color thermal-transfer recording medium.

The thermal-transfer recording medium thus prepared was set in a thermal transfer printer. Using transfer media such as a white polyester label, vinyl chloride label, YUPO label, peach-coat label, silver naming label, printing, including random superimpositional printing, was performed with each of the thermal-transfer recording media under the printing conditions of 8 dot/mm, 0.2 to 0.4 mj/dot and 2 inch/min, so as to produce a print. The results of printing are shown in Table 1.

The thermal-transfer recording medium obtained in example 12 was set in a thermal transfer printer and used to perform printing onto a white polyester label under the printing conditions of 8 dot/mm, 0.2–0.4 mj/dot and 2 inch/min. Then the thermal-transfer recording medium obtained in example 3 was used to perform printing superimposedly on the same label, to thereby produce a multi-color print.

The thermal-transfer recording media obtained in examples 12, 13 and 14 were set in a multi-head thermal transfer printer having three printing heads and used to perform superimpositional printing of the individual ink layers onto a white polyester label under the printing conditions of 8 dot/mm, 0.2–0.4 mj/dot and 2 inch/min, to thereby produce a multi-color print.

The thermal-transfer recording medium, obtained in example 17 was set in a thermal transfer printer for multi-color printing, the cyan ink layer section was to printed onto a white polyester label under the printing conditions of 8 dot/mm, 0.2–0.4 mj/dot and 2 inch/min. Then, the label was rewound so that the magenta ink layer section was printed superimposedly in part over the cyan print. Again, the label was rewound so that the yellow ink layer section was printed so as to be partially laid over the printed ink layers, to thereby produce a multi-color print on the same label. The results of printing are shown in Table 2.

TABLE 2

| | | | In superimpositional printing | | |
|---|---|---|---|---|---|
| | | 1st transfer performance | Transfer performance | Color reproducibility | Abrasion resistance |
| Ex. 11 | tan δ = 3.0–57.0 Complex dynamic viscosity = 95–13,400 Pa's | A | A | — | A |
| Ex. 12 | tan δ = 3.0–57.0 Complex dynamic viscosity = 95–13,400 Pa's | A | A | A | A |
| Ex. 13 | tan δ = 3.2–19.0 Complex dynamic viscosity = 37–3,800 Pa's | A | A | A | A |

TABLE 2-continued

| | | | In superimpositional printing | | |
|---|---|---|---|---|---|
| | | 1st transfer performance | Transfer performance | Color reproducibility | Abrasion resistance |
| Ex. 14 | tan δ = 3.0–57.0 Complex dynamic viscosity = 95–13,400 Pa's | A | A | A | A |
| Ex. 15 | tan δ = 3.2–19.0 Complex dynamic viscosity = 37–3,800 Pa's | A | A | A | A |
| Ex. 16 | tan δ = 3.2–19.0 Complex dynamic viscosity = 37–3,800 Pa's | A | A | A | A |
| Ex. 17 | — | A | A | A | A |
| CEx. 4 | tan δ = 0.26–1.4 Complex dynamic viscosity = 3,180–21,800 Pa's | C | C | — | A |
| CEx. 5 | tan δ = 0.53–8.1 Complex dynamic viscosity = 430–36,500 Pa's | C | C | C | A |
| CEx. 6 | tan δ = 11.4–57.2 Complex dynamic viscosity = 0.8–20 Pa's | B | C | — | C |

Evaluations were made on the first transfer performance of the first printing, the transfer performance and color reproducibility of the superimpositional print, and abrasion resistance of the print, by the aforementioned estimating methods.

As apparent from Table 2, the prints obtained by the thermal-transfer recording media of the invention shown in examples 11–17 are all excellent in the first transfer performance and satisfactory in the transfer performance and color reproducibility of superimpositional printing as well as being excellent in abrasion resistance.

In contrast, the prints obtained by the thermal-transfer recording media of comparative examples 4 and 5 presented bad transfer performance because the elasticity response was too high during heating. The abrasion resistance in areas where transfer could be done was relatively fair only.

Concerning the thermal-transfer recording medium of comparative example 6, the first transfer performance was high but the transfer performance of the superimpositional printing was such that when overlapping printing was attempted on the top of these transferred ink layers, the ink layers fused, resulting in color unevenness due to ink mixing and transfer failure due to ink repellence. Also the abrasion resistance of the print was low.

INDUSTRIAL APPLICABILITY

As has been described heretofore, it is possible to perform good printing even to transfer print media having a surface state which is hard to thermally transfer ink thereto. Also when multiple number of colors are thermally transferred in layers, the transferred ink layers form a well-ordered laminar structure, so that it is possible to perform good superimpositional printing. Further, the image after printing will not rub off or damage due to strong mechanical abrasion and the like. Thus, the present invention is very effective in maintaining the print in a good printed state.

We claim:

1. A thermal-transfer recording medium at least comprising:

a support; and a thermal-transfer ink layer provided on the support, wherein the thermal-transfer ink layer consists of an ink composition which is in a softened state within the temperature range of 100 to 150° C. and presents the following behaviors (A) and (B) in the viscoelasticity measurement with a frequency of 1 Hz in the linear viscoelastic region of temperature from 100 to 150° C.:

(A) tanδ of 1 or more, (B) the complex dynamic viscosity falls within 100 to 40,000 Pa.s.

2. The thermal-transfer recording medium according to claim 1, wherein the thermal-transfer ink layer contains a pigment and a vehicle, and the pigment is organic.

3. The thermal-transfer recording medium according to claim 1, wherein the thermal-transfer ink layer contains an inorganic pigment and a vehicle and the ratio of the refractive index Np of the inorganic pigment to the refractive index Nr of the vehicle falls within the range of:

$$Np/Nr=1.00-1.12.$$

4. A thermal-transfer recording method comprising the steps of:

using a plurality of thermal-transfer ink layers, each consisting of an ink composition which is in a softened state within the temperature range of 100 to 150° C. and presents the following behaviors (A) and (B) in the viscoelasticity measurement with a frequency of 1 Hz in the linear viscoelastic region of temperature from 100 to 150° C.:

(A) tanδ is of 1 or more, (B) the complex dynamic viscosity falls within 100 to 40,000 Pa.s, and transferring each of the thermal-transfer ink layers superimposedly onto the transfer medium to perform multicolor printing.

5. The thermal-transfer recording method for performing color printing according to claim 4, wherein each thermal-transfer ink layer contains a pigment and a vehicle and the pigment is organic.

6. The thermal-transfer recording medium for performing color printing according to claim 4, wherein each thermal-transfer ink layer contains an inorganic pigment and a vehicle and the ratio of the refractive index Np of the inorganic pigment to the refractive index Nr of the vehicle falls within the range of:

$$Np/Nr=1.00-1.12.$$

7. A thermal-transfer recording medium at least comprising:

a support; and a thermal-transfer ink layer provided on the support, wherein the thermal-transfer ink layer contains a coloring matter and a thermo-fusing resin, and the thermo-fusing resin is in a softened state within the temperature range of 100 to 150° C. and presents the following behaviors (A) and (B) in the viscoelasticity measurement with a frequency of 1 Hz in the linear viscoelastic region of temperature from 100 to 150° C.:

(A) tanδ of 1.7 or more, (B) the complex dynamic viscosity falls within 10 to 20,000 Pa.s.

8. The thermal-transfer recording medium according to claim 7, wherein the coloring matter is an organic pigment.

9. The thermal-transfer recording medium according to claim 7, wherein the coloring matter at least comprises an inorganic pigment and the ratio of the refractive index Np of the inorganic pigment to the refractive index Nr of the vehicle falls within the range of:

$$Np/Nr=1.00-1.12.$$

* * * * *